US009992564B2

(12) United States Patent
Wang

(10) Patent No.: US 9,992,564 B2
(45) Date of Patent: Jun. 5, 2018

(54) SPEAKER ASSEMBLY

(71) Applicant: AMTRAN TECHNOLOGY CO., LTD, New Taipei (TW)

(72) Inventor: Ko-Chung Wang, Taoyuan (TW)

(73) Assignee: AMTRAN TECHNOLOGY CO., LTD, New Taipei (TW)

( * ) Notice: Subject to any disclaimer, the term of this patent is extended or adjusted under 35 U.S.C. 154(b) by 0 days. days.

(21) Appl. No.: 15/287,712

(22) Filed: Oct. 6, 2016

(65) Prior Publication Data

US 2018/0103305 A1 Apr. 12, 2018

(51) Int. Cl.
*H04R 1/02* (2006.01)

(52) U.S. Cl.
CPC ..... *H04R 1/025* (2013.01); *H04R 1/026* (2013.01); *H04R 2499/15* (2013.01)

(58) Field of Classification Search
CPC ..... H04R 1/025; H04R 1/26; H04R 2499/15
USPC ..... 381/333, 335, 345, 349, 361
See application file for complete search history.

(56) References Cited

U.S. PATENT DOCUMENTS

2013/0050591 A1* 2/2013 Kita ..... G06F 1/1607 348/836
2014/0160040 A1* 6/2014 Kang ..... H04R 17/005 345/173
2015/0146904 A1* 5/2015 Chien ..... H04R 1/025 381/333
2016/0134955 A1* 5/2016 Li ..... H04R 1/403 381/349

* cited by examiner

*Primary Examiner* — William A Jerez Lora
(74) *Attorney, Agent, or Firm* — Maschoff Brennan

(57) ABSTRACT

A speaker assembly has a mounting box and a speaker. The mounting box has one bottom plate, a first sidewall, a second sidewall, and a third sidewall. The speaker is mounted on the mounting box. The third sidewall is between the first sidewall and the second sidewall, and the speaker and the three sidewalls define an opening. A display device has a casing, a backlight module and the aforementioned speaker assembly. The backlight module is in the casing, and the speaker assembly is located in a space defined by the casing and the backlight module.

16 Claims, 5 Drawing Sheets

SPEAKER ASSEMBLY

TECHNICAL FIELD

The invention is related to a speaker assembly, and more particularly to a speaker assembly for display device.

BACKGROUND

The speaker assembly is an important component in the display device. The max sound pressure level (max SPL) of one speaker assembly is positively related to the volume of the speaker assembly. However, if the volume of one speaker assembly is increased, the volume or the thickness of the display device utilizing the speaker assembly will be increased as well. Hence, how to increase the max SPL of one speaker assembly without increasing the volume thereof, or how to maintain the max SPL of one speaker assembly while decreasing the volume thereof is a problem to be solved.

SUMMARY

In one embodiment of the disclosure, a speaker assembly has a mounting box and a speaker. The mounting box has one bottom plate, a first sidewall, a second sidewall, and a third sidewall. The speaker is mounted on the mounting box. The third sidewall is between the first sidewall and the second sidewall, and the speaker and the three sidewalls define an opening.

In another embodiment of the disclosure, a display device has a casing, a backlight module and the aforementioned speaker assembly. The backlight module is in the casing, and the speaker assembly is located in a space defined by the casing and the backlight module.

In order to make the aforementioned and other features of the present invention more comprehensible, several embodiments accompanied with figures are described in detail below.

BRIEF DESCRIPTION OF THE DRAWINGS

The present invention will become more fully understood from the detailed description given herein below for illustration only, and thus are not limitative of the present invention, and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
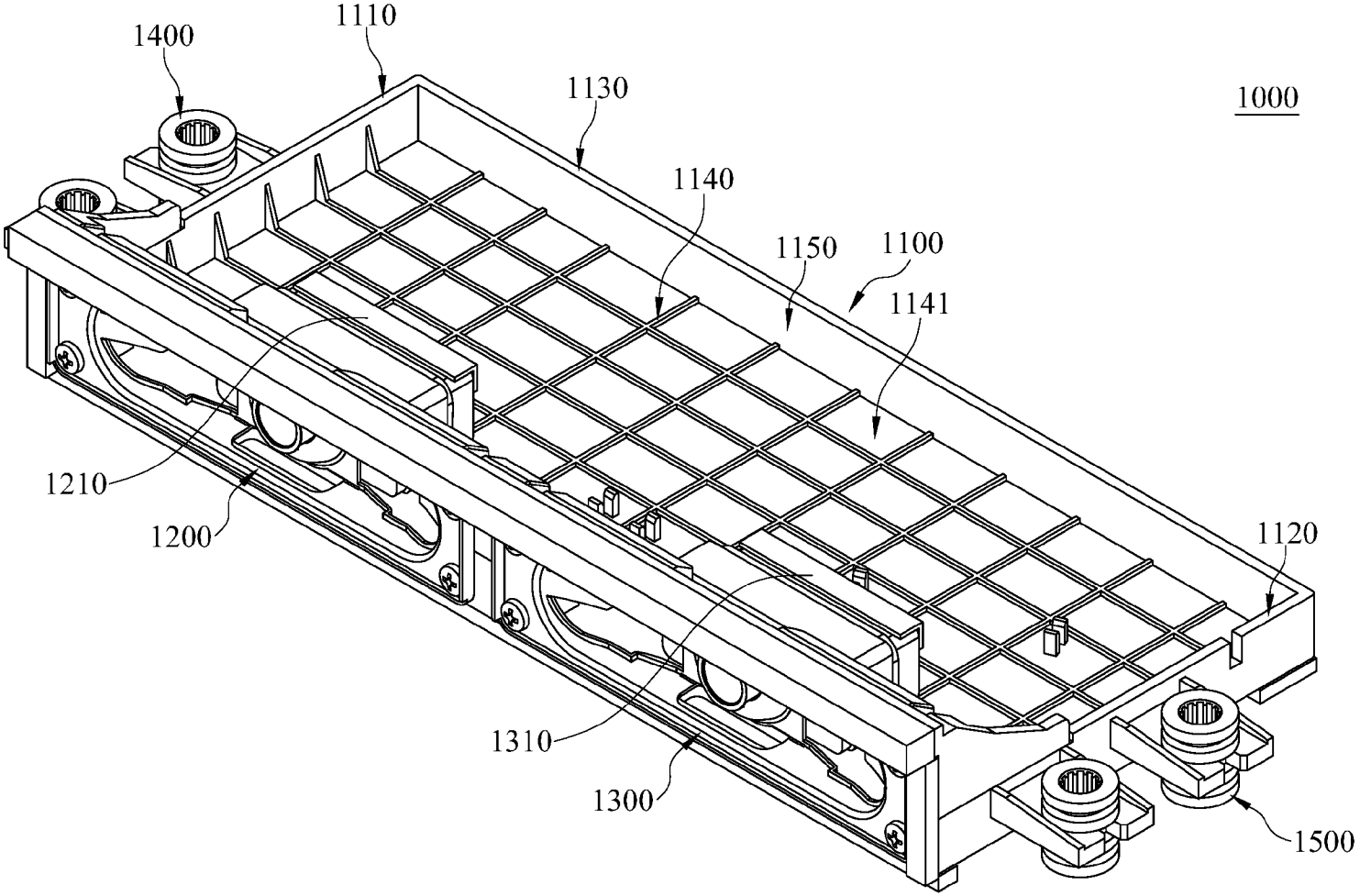
FIG. 1 is a diagram of a structure of a speaker assembly according to one embodiment of the disclosure.

Please refer to FIG. 1, which is a diagram of a structure of a speaker assembly according to one embodiment of the disclosure. As shown in FIG. 1, a speaker assembly 1000 according to one embodiment of the disclosure has a mounting box 1100 and two speakers 1200 and 1300. The mounting box 1100 has a first sidewall 1110, a second sidewall 1120, a third sidewall 1130, and a bottom plate 1140. The third sidewall 1130 is between the first sidewall 1110 and the second sidewall 1120. In the embodiment as shown in FIG. 1, the bottom plate 1140 has a plurality of recesses 1141. In another embodiment, the bottom plate 1140 has an even surface.

The speaker 1200 and the speaker 1300 are installed on the edge of the bottom plate 1140, so the speaker 1200, the speaker 1300, the sidewalls 1110~1130 together define an opening 1150.

Figure 2:
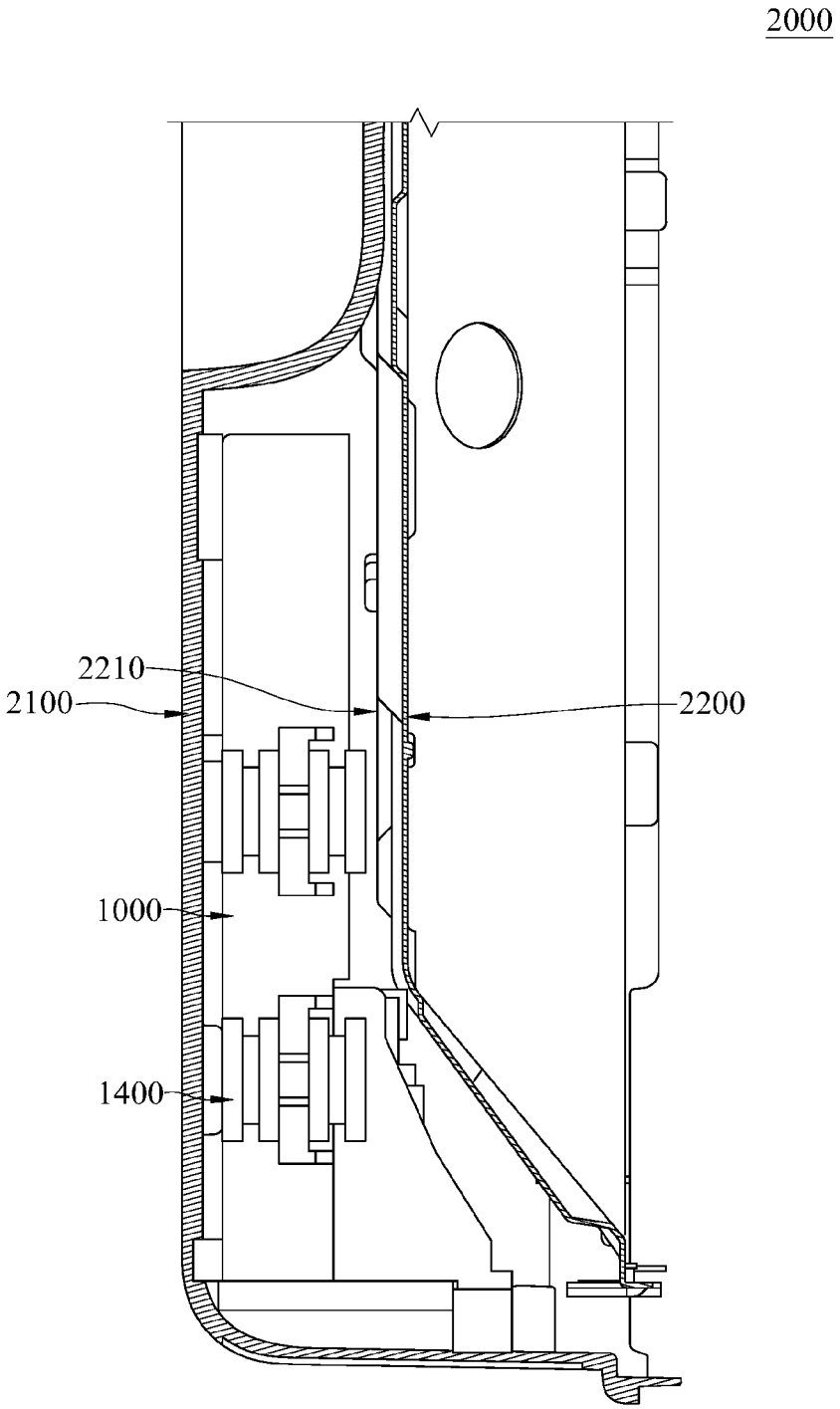
FIG. 2 is a sectional view of a structure of a display device according to one embodiment of the disclosure.

Please now refer to FIG. 2, which is a sectional view of a structure of a display device according to one embodiment of the disclosure. As shown in FIG. 2, a display device 2000 has a casing 2100, a backlight module 2200, and the aforementioned speaker assembly 1000. The backlight module 2200 is in the casing 2100. The speaker assembly 1000 is located in the space defined by the casing 2100 and the backlight module 2200. Explicitly, when the backlight module 2200 is installed in the casing 2100, there is a space left between the backlight module 2200 and the casing 2100, and the speaker assembly 1000 is installed in that space.

In one embodiment, the mounting box 1100, the speaker 1200, the speaker 1300, and the back surface 2210 of the backlight module 2200 together form a resonant cavity. Hence, the shape of the back surface 2210 conforms to the shape of the first sidewall 1110, the second sidewall 1120, the third sidewall 1130, the speaker 1200, and the speaker 1300.

In one embodiment, the height H3 of the third sidewall 1130 is less than the height HS of the speaker 1200 or the speaker 1300. In another embodiment, the height H3 of the third sidewall 1130 is less than the average height H1 of the first sidewall 1110 or the average height H2 of the second sidewall 1120. In one embodiment, the top surface of the first sidewall 1110 is uneven so as to conform to the shape of the back surface 2210. Similarly, the top surface of the second sidewall 1120 is uneven so as to conform to the shape of the back surface 2210.

In one embodiment, to reduce the noise result from the vibration and the collision between the casing 2100 and the speaker assembly 1000, the speaker assembly 1000 further has a first fixing component 1400 directly connected and fixed to the first sidewall 1110 and a second fixing component 1500 directly connected and fixed to the second sidewall 1120. In one embodiment, the first fixing component 1400 is a screw hole so that the first fixing component 1400 can be fixed on the casing 2100 by a screw. Similarly, the second fixing component 1500 can also be fixed on the casing 2100 by a screw. In another embodiment, the first fixing component 1400 can be fixed on the back surface 2210 of the backlight module 2200 by a screw. The second fixing component 1500 can be fixed on the back surface 2210 of the backlight module 2200 by a screw.

In another embodiment, the speaker assembly 1000 may have only one speaker when the space left by the back surface 2210 and the casing 2100 is not enough for the speaker assembly with two speakers.

Figure 3:
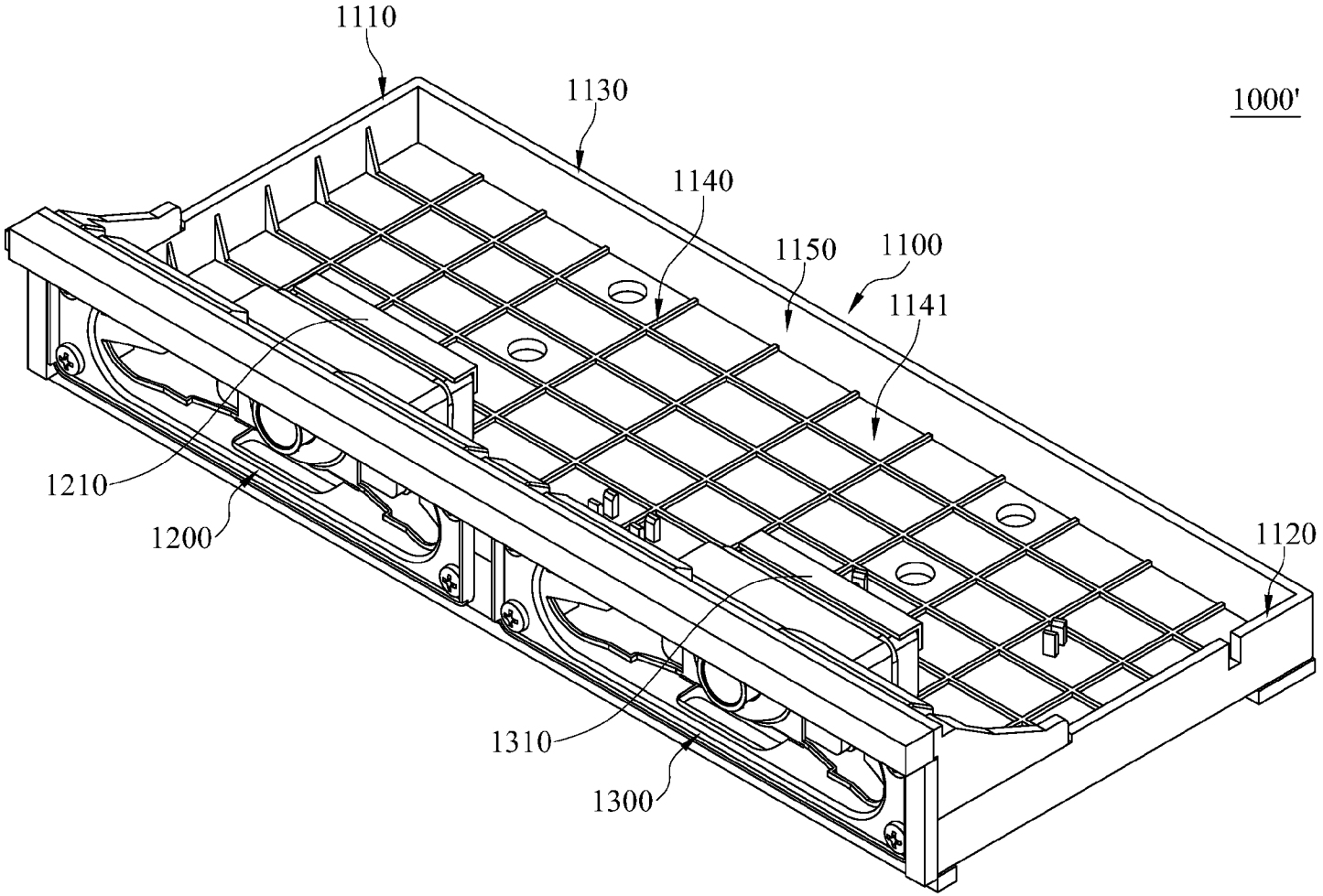
FIG. 3 is a diagram of a structure of a speaker assembly according to another embodiment of the disclosure.

In another embodiment, the speaker assembly 1000 may have no aforementioned fixing component. Instead, please refer to FIG. 3, which is a diagram of a structure of a speaker assembly according to another embodiment of the disclosure. As shown in FIG. 3, the speaker assembly 1000', compared with the speaker assembly 1000 in FIG. 1, has no fixing component connected to the first sidewall or the second sidewall. The speaker assembly 1000' has a plurality of screw holes 1142 on the bottom plate 1140. Hence, the speaker assembly 1000' may be fixed on the casing 2100 by screws and the screw holes 1142.

Figure 4:
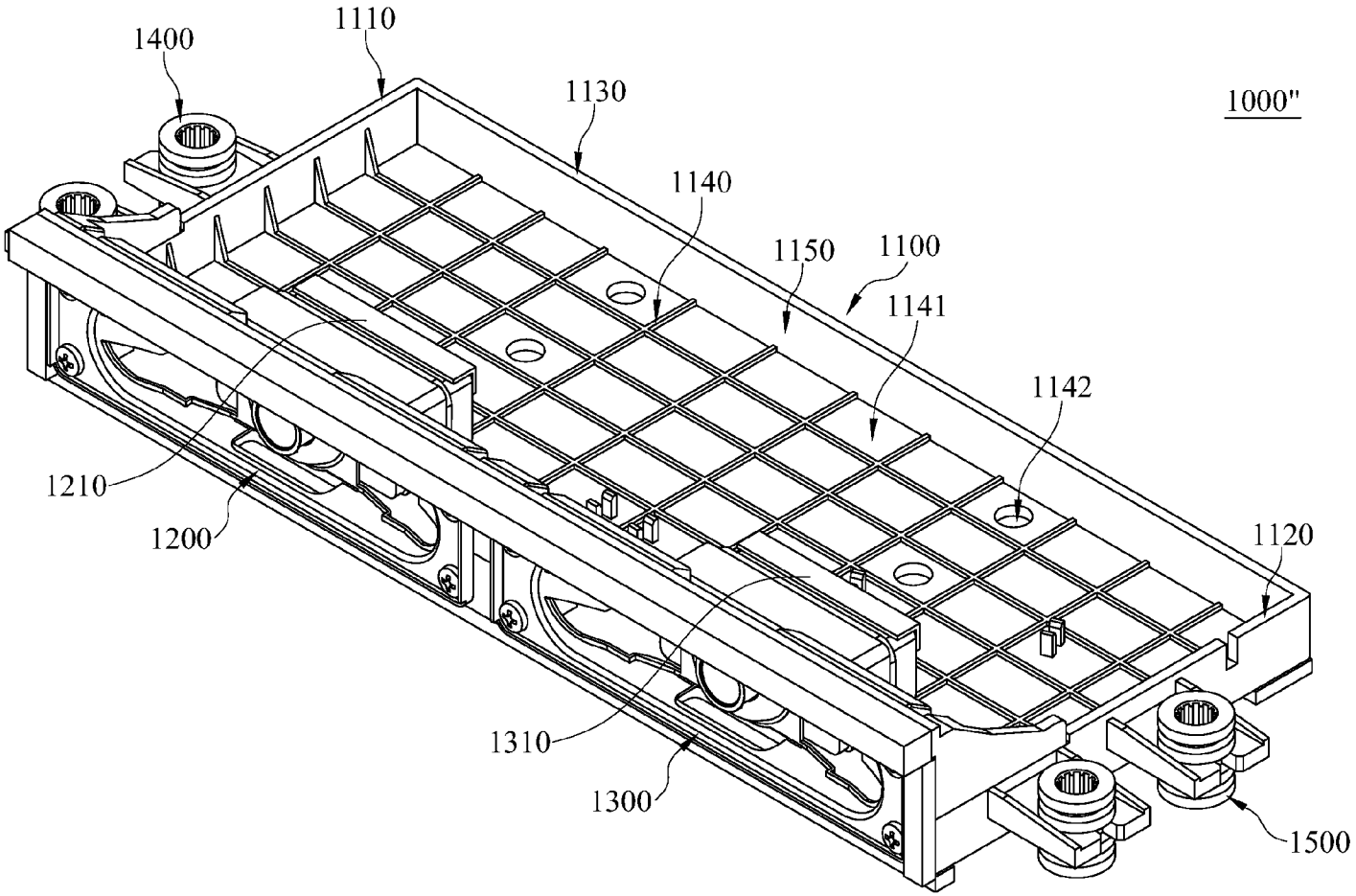
FIG. 4 is a diagram of a structure of a speaker assembly according to another embodiment of the disclosure.

In yet another embodiment, please refer to FIG. 4, which is a diagram of a structure of a speaker assembly according to another embodiment of the disclosure. As shown in FIG. 4, the speaker assembly 1000" has fixing components 1400 and 1500, and the bottom plate 1140 has a plurality of screw holes 1142. Hence, the speaker assembly 1000" may be fixed on the casing 2100 by screws and the screw holes 1142 and fixed on the back surface 2210 of the backlight module 2200 by screws and the fixing components 1400 and 1500.

Accordingly, when the speaker 1200 and the speaker 1300 are driven by electric currents to vibrate, the collision between the speaker assembly 1000" and the casing 2100 or the collision between the speaker assembly 1000" and the back surface 2210 may be reduced by the fixing mechanism aforementioned. That is, the noise result from the vibration and the collision between devices may be reduced.

Figure 5:
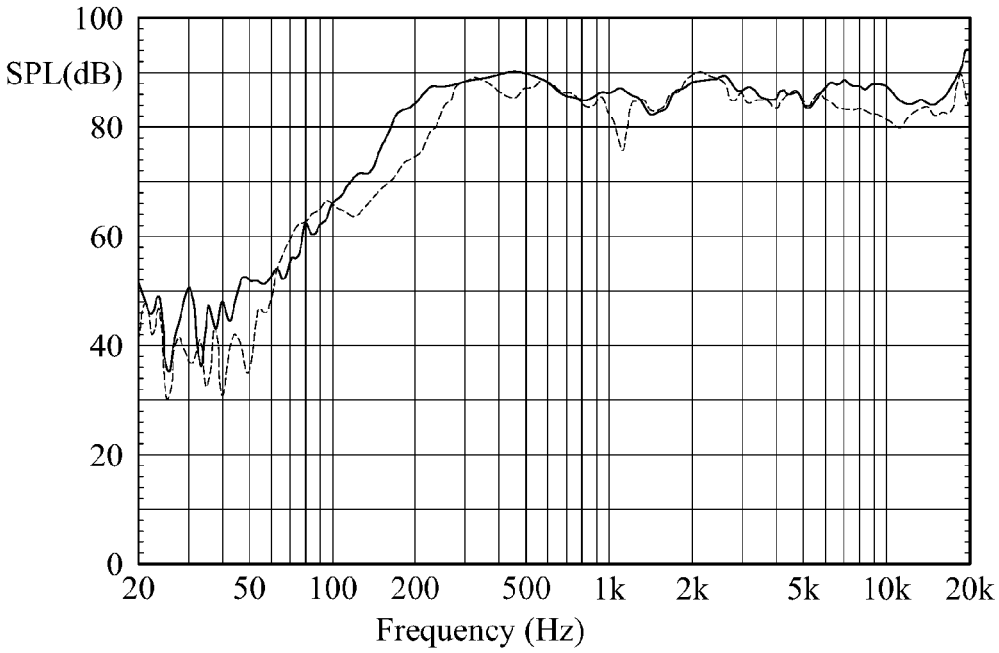
FIG. 5 illustrates a sound pressure level to frequency diagrams of a display device with speaker assembly.

Please now refer to FIG. 5, which illustrates "sound pressure level (SPL)—frequency" curves respectively for the disclosed display device with speaker assembly and conventional display device. In FIG. 5, the solid line is the SPL-frequency curve of the display device in FIG. 2, while the dashed line is the SPL-frequency diagram of a compared embodiment, which is a conventional display device without the opening shown in FIG. 1. As shown in FIG. 5, the SPL of the display device in FIG. 2 is better than the SPL of the compared embodiment.

In yet another embodiment, please refer back to FIG. 1. Because the speaker assembly 1000 has the opening defined by the sidewalls and the speakers, one or more supplemental magnet may be installed in the speaker assembly 1000. For example, as shown in FIG. 1, the speaker 1200 has a supplemental magnet 1210, and the speaker 1300 has a supplemental electromagnet 1310.

While designing a speaker assembly of the embodiment of the disclosure for a display device, one having ordinary skill in the art may firstly measure the space left by the casing 2100 and the backlight module 2200. Then, according to the shape of the space, he or she may design a speaker assembly as shown in FIG. 1, FIG. 3, or FIG. 4. Further, according to specific SPL requirement, one having ordinary skill in the art may optionally install the supplemental magnet 1210 and 1310 onto the speaker 1200 and 1300, respectively.

In summary, the opening defined by the sidewalls and the speakers provides an option for installation of the supplemental magnets. With the opening of the speaker assembly, the display device incorporating the disclosed speaker assembly outputs a higher sound pressure than that from a display incorporating a conventional speaker assembly. Thus, the disclosed speaker assembly brings better sound quality to consumers. In addition, due to the fact that the opening formed in the disclosed speaker assembly fits to the back surface of the backlight module, the display device incorporating the disclosed speaker assembly has a thinner screen thickness and less weight than conventional displays.

What is claimed is:

1. A speaker assembly, comprising:

a mounting box having one bottom plate, a first sidewall, a second sidewall, and a third sidewall; and a speaker mounted on the mounting box;

wherein the third sidewall is between the first sidewall and the second sidewall, the speaker and the three sidewalls define an opening, and the speaker assembly is not closed before assembled into a display device and forms a resonant cavity together with a backlight module.

2. The speaker assembly according to claim 1, wherein a height of the third sidewall is different from a height of each of the first sidewall and the second sidewall.

3. The speaker assembly according to claim 1, wherein a height of the third sidewall is different from a height of the speaker.

4. The speaker assembly according to claim 1, wherein each of the first sidewall and the second sidewall has an uneven top surface.

5. The speaker assembly according to claim 1, further comprising:

a first fixing component directly connected on the first sidewall; and a second fixing component directly connected on the second sidewall.

6. The speaker assembly according to claim 1, wherein the bottom plate has an even surface.

7. The speaker assembly according to claim 1, wherein the bottom plate has a plurality of recesses.

8. A display device, comprising:

a casing;

a backlight component in the casing; and a speaker assembly in a space defined by the casing and the backlight module, wherein the speaker assembly comprises:

a mounting box having one bottom plate, a first sidewall, a second sidewall, and a third sidewall; and a speaker mounted on the mounting box;

wherein the third sidewall is between the first sidewall and the second sidewall, and the speaker and the three sidewalls define an opening;

wherein a back surface of the backlight module covers the opening defined by the speaker and the three sidewalls;

wherein the speaker assembly and the back surface of the backlight module together form a resonant cavity.

9. The display device according to claim 8, wherein a height of the third sidewall is different from a height of each of the first sidewall and the second sidewall.

10. The display device according to claim 8, wherein a height of the third sidewall is different from a height of the speaker.

11. The display device according to claim 8, wherein each of the first sidewall and the second sidewall has an uneven top surface.

12. The display device according to claim 8, wherein shapes of the three sidewalls conform to a shape of the back surface of the backlight module.

13. The display device according to claim 8, wherein the speaker assembly further comprises:

a first fixing component directly connected on the first sidewall and fixed on the casing; and a second fixing component directly connected on the second sidewall and fixed on the casing.

14. The display device according to claim 13, wherein both of the first fixing component and the second fixing component are also fixed on the backlight module.

15. The display device according to claim 8, wherein the bottom plate has an even surface.

16. The display device according to claim 8, wherein the bottom plate has a plurality of recesses.

* * * * *